US005620128A

United States Patent [19]

Dingman et al.

[11] Patent Number: 5,620,128

[45] Date of Patent: Apr. 15, 1997

[54] DISPENSER FOR ROLLED SHEET MATERIAL

[75] Inventors: Robert K. Dingman, 3060 Lakeshore, Benton Harbor, Mich. 49022; Narasimha S. Paravastu, Clifton, N.J.

[73] Assignee: Robert K. Dingman, Benton Harbor, Mich.

[21] Appl. No.: 389,951

[22] Filed: Feb. 17, 1995

[51] Int. Cl.[6] ..... B26F 3/02

[52] U.S. Cl. ..... 225/19; 225/41; 225/42; 225/43; 220/326

[58] Field of Search ..... 225/19, 39, 41, 225/42, 43, 49, 50; 242/590, 596.8, 598.6; 220/326

[56] References Cited

U.S. PATENT DOCUMENTS

| | | | |
|---|---|---|---|
| 1,693,338 | 11/1928 | Honschopp | 225/41 X |
| 2,106,363 | 1/1938 | Tesher et al. | 225/43 X |
| 2,132,177 | 10/1938 | Mezoff | 225/43 X |
| 2,507,404 | 5/1950 | Gluck | 225/50 |
| 2,543,169 | 2/1951 | Hicks . | |
| 2,580,684 | 1/1952 | Lacy et al. | 225/42 |
| 2,597,602 | 5/1952 | Sipior | 225/19 |
| 2,614,015 | 10/1952 | McGehee | 225/42 X |
| 2,695,208 | 11/1954 | Graham | 225/42 X |
| 2,717,074 | 9/1955 | Williamson et al. | 225/50 X |
| 2,861,753 | 11/1958 | Sipior . | |
| 2,984,395 | 5/1961 | Catlett et al. | 225/42 |
| 3,178,086 | 4/1965 | Palmer | 225/41 |
| 3,281,032 | 10/1966 | Solomon | 225/42 X |
| 3,492,056 | 1/1970 | Murray . | |
| 3,667,597 | 6/1972 | Hollister . | |
| 3,870,212 | 3/1975 | Polk | 225/42 |
| 4,204,618 | 5/1980 | Reed et al. | 225/41 X |
| 4,474,318 | 10/1984 | Perrin | 225/50 |
| 4,779,780 | 10/1988 | Scharf | 225/42 |
| 5,186,376 | 2/1993 | Scharf et al. | 225/42 |
| 5,222,644 | 6/1993 | Moreno | 225/19 |

*Primary Examiner*—Eugenia Jones

*Attorney, Agent, or Firm*—Weiner, Carrier & Burt, P.C.; Pamela S. Burt; Irving M. Weiner

[57] ABSTRACT

A clamshell type container for dispensing paper having upper and lower hingedly connected portions. The container may be transparent, and may enclose a conventional box of wax paper or plastic wrap for dispensing. A safety front edge protects the user against cuts when cutting the dispensed paper. A resiliently-biased releasable locking mechanism holds the container in a closed position.

8 Claims, 1 Drawing Sheet

DISPENSER FOR ROLLED SHEET MATERIAL

BACKGROUND OF THE INVENTION

1. Field of the Invention

The present invention relates generally to dispensing containers, and methods of constructing and utilizing same. In particular, the present invention relates to a novel clamshell type container which permits very fast and easy loading of the material to be dispensed.

2. Description of the Relevant Art

The relevant art is exemplified by the following United States patents.

Hicks U.S. Pat. No. 2,543,169, entitled "HOLDER FOR WAX PAPER DISPENSERS", discloses a holder wherein the wax paper dispenser is not fully enclosed, and wherein there is no cutting edge on the holder. The Hicks holder does not pivot or hinge open.

Sipior U.S. Pat. No. 2,861,753, entitled "PAPER DISPENSERS", discloses a dispenser wherein a paper roll, without a container, is put into the dispenser. The Sipior holder does not pivot open, and has a circular end loading opening. The Sipior device is made of metal, and has a plurality of supporting flanges which extend slightly beyond the edge of the cut-off blade. In Sipior the paper roll is supported by means of a rod or shaft mounted upon brackets within a casing. Sipior has a major disadvantage in that it is necessary to provide for threading of the free end of the paper into the device as the roll itself is inserted therein.

Murray U.S. Pat. No. 3,492,056, entitled "KITCHEN CABINET BUILT-IN DISPENSER FOR ROLLED SHEET MATERIAL", discloses a housing which is not hinged, and which is open at the bottom. The Murray device provides no cutting edge, and a roll itself without any container is placed into the housing. Murray uses a standard U-shaped bracket.

Hollister U.S. Pat. No. 3,667,597, entitled "CONTAINER FOR DISPENSING PAPER", discloses a device wherein the paper roll itself, without any container, is placed into the dispensing container. Hollister provides no device for cutting the paper.

None of the relevant art devices provides a construction and assembly which overcomes all of the objectionable characteristics of such devices. Indeed, it is a desideratum of the present invention to avoid the animadversion of the relevant art devices.

SUMMARY OF THE INVENTION

The term "substantially thin material" as used herein is intended to include, but is not limited to, all types of paper, foil, wax paper, paper toweling, and other types of sheet-like material.

The present invention provides a clamshell type container for dispensing substantially thin material, comprising an upper container portion, and a lower container portion hingedly interconnected to the upper container portion. The upper container portion and the lower container portion form an enclosure within which the substantially thin material may be disposed. There are included first means for releasably locking the upper container portion and the lower container portion in a closed position. The first means is operably connected to the upper container portion and to the lower container portion. The upper container portion and the lower container portion when in the closed position form a predetermined aperture through which at least a portion of the substantially thin material may pass. The clamshell type container includes second means disposed adjacent the predetermined aperture. The second means facilitates cutting of the substantially thin material, and at the same time protects a user of the container from being cut thereby when cutting the substantially thin material.

It is therefore an object of the present invention to provide a dispenser which is of the clamshell type design which allows fast loading of the wax paper or other product.

Another object of the invention is to provide an under cabinet dispenser for storing and dispensing sheet or foil material.

Another object of the invention is to provide a clamshell type container for dispensing substantially thin material, wherein the container is constructed of transparent plastic, and which has a recessed non-protruding hinge.

Yet another object of the invention is to provide a clamshell type container which permits very fast and easy loading of the product to be dispensed.

Another object is to provide a container which has a cutting edge in front of the dispensing aperture so that a downward motion dispenses the product, and a forward motion cuts or tears off the product.

Another object is to provide a clamshell type container as described above wherein the product or material to be dispensed is more visible and is stored in its original condition or container.

Another object is to provide a dispenser wherein the material is readily accessible for each successive dispensing.

Another object is to provide such a clamshell type container wherein the hinge is contiguous with the body of the container.

Another object is to provide such a clamshell type container which has holes for mounting placed on the top of the container, as well as on the back wall for facilitating mounting thereof.

Yet another object of the present invention is to provide a clamshell type container as described above having a novel releasable locking mechanism.

A further object of the invention is to provide a clamshell type container as described above which has a very simple and novel cutting device which permits easy cutting of the dispensed product, while at the same time preventing a user thereof from being cut thereby.

Other objects, advantages, and applications of the present invention will become apparent to those skilled in the art of dispensing containers when the accompanying description of the present invention is read in conjunction with the accompanying drawings.

BRIEF DESCRIPTION OF THE DRAWINGS

The description herein makes reference to the accompanying drawings wherein like reference numerals refer to like or equivalent parts and in which.

DESCRIPTION OF SOME PREFERRED EMBODIMENTS

Figure 1:
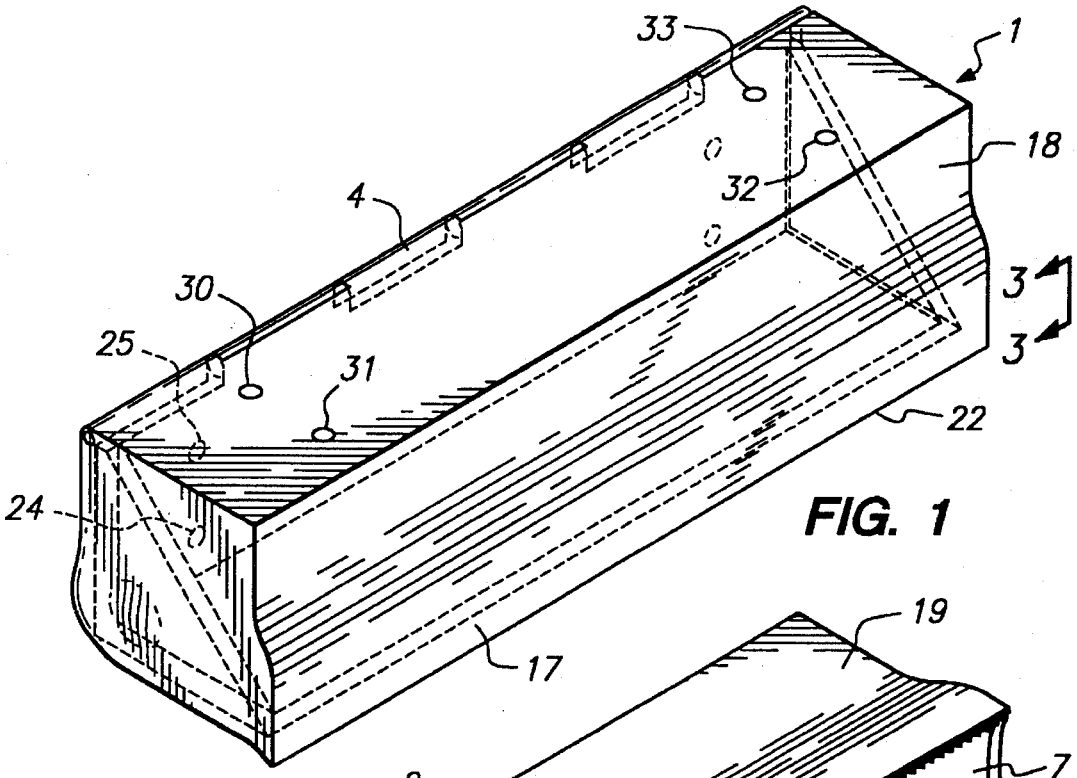
FIG. 1 illustrates a perspective view of one embodiment of the present invention, wherein the clamshell type container is shown in a closed position.
Figure 2:
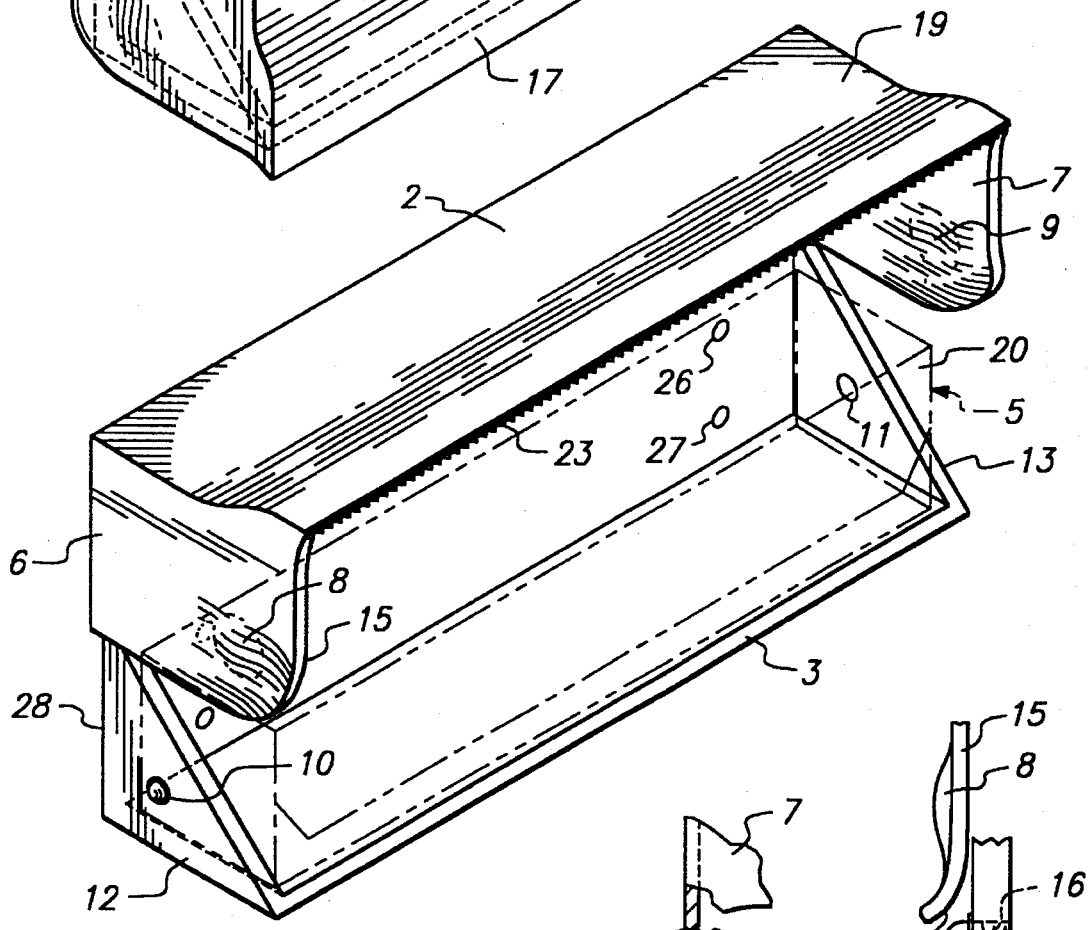
FIG. 2 illustrates another perspective view of the present invention, wherein the clamshell type container is shown in an open position.

Referring to the drawings, and particularly to FIGS. 1 and 2, one example of the present invention is illustrated in the form of a clamshell type container 1 for dispensing rolled sheet material, such as wax paper or plastic wrap, or the like.

The clamshell type container 1 comprises an upper container portion 2, and a lower container portion 3 which is hingedly interconnected to the upper container portion 2. Upper container portion 2 includes a top wall, a front wall, and respective side wall members 6, 7; while lower container portion 3 includes a bottom wall, a back wall, and respective side members 12, 13. The container 1 is preferably, but not necessarily, fabricated from substantially transparent material, such as plastic or glass. In one form of the present invention, the container 1 may be fabricated from material in the range of 3 to 5 mm thick. The container 1 is provided with a recessed, non-protruding hinge 4 which is preferably, but not necessarily, contiguous with the body of the container.

FIG. 2 shows the container 1 in its open position for loading in a conventional box 5 of wax paper or plastic wrap which is shown in phantom line in the drawing. This feature of the invention allows extremely fast and easy loading of the material to be dispensed, without the necessity of taking apart any mechanical parts, arranging any spring-loaded brackets, or mounting on any holding rods, etc.

After the box 5 of material to be dispensed is placed in the container 1, the user merely swings the hinge-mounted upper container portion 2 downwardly to close the container 1. As upper container portion 2 continues to swing downwardly, the novel first means for releasably locking the upper container portion 2 and the lower container portion 3 in a closed position comes into play.

The upper container portion 2 is provided at each end with novel, specially-designed, predetermined depending side members 6 and 7 which are preferably, but not necessarily, arcuately-shaped. The arcuately-shaped depending side members 6 and 7 are also formed with predetermined concave portions 8 and 9 (best illustrated in FIG. 4) each of which accommodates a releasable resiliently biased locking member 10 or 11 mounted on side members 12 or 13, respectively, of the lower container portion 3.

Figure 4:
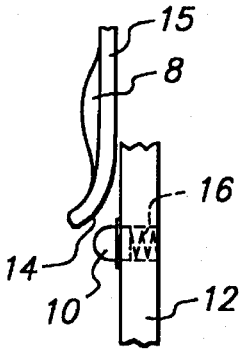
FIG. 4 is a fragmentary view illustrating a portion of one form of the novel releasable locking mechanism of the present invention.

As the upper container portion 2 is swung downwardly, a part 14 of its arcuately-shaped surface 15 first contacts the locking member 10 or 11, and urges it inwardly against a resilient force, such as that applied, for example, by a spring 16 as shown in FIG. 4. As the upper container portion 2 continues to swing downwardly, the locking member 10 or 11 seats itself within the concavity 8 or 9 of the arcuately-shaped depending side members 6 or 7, respectively.

When it is desired to again open the container 1, movement of the upper container portion 2 upwardly readily releases the locking member 10 or 11 from the concavity 8 or 9, respectively.

The upper container portion 2 and the lower container portion 3 when in the closed position form a predetermined aperture 17 through which the end portion (not shown) of the material to be dispensed may pass.

In the closed position, an inner upper portion 18 of the front wall 19 of the upper container portion 2 may optionally, but not necessarily, contact the front flange surface 20 of the conventional box 5 of material to be dispensed.

The container 1 is also provided with a device for cutting the dispensed material. This device may take many forms, including a cutting blade, cutting serrations, etc. The embodiment illustrated in the drawings shows a cutting edge 21 (see FIG. 3) positioned in front of the dispensing aperture 17 so that a downward motion dispenses the sheet material, and a forward motion cuts or tears off such material.

Figure 3:
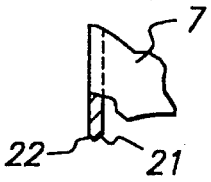
FIG. 3 is a fragmentary view taken along line 3—3 shown in FIG. 1.

As shown in FIG. 1 and FIG. 3, there is provided a smooth front safety edge 22 in front of and parallel to the cutting edge 21. This novel front safety edge 22 prevents the user from getting cuts on the fingers or hands when cutting the dispensed material.

Preferably, but not necessarily, the cutting edge 21 may comprise a plurality of serrations 23 wherein the teeth of the serrations 23 may, for example, be separated by approximately 1 mm. The serrated teeth may also taper from, for example, approximately 3 mm to approximately 1 mm thick to a point adjacent the smooth front safety edge 22.

It is important to note that the serrations 23 of the cutting edge 21 are in a hidden or guarded position, i.e., the serrations 23 are positioned toward the rear and are not directly accessible from the front.

Two or more mounting holes 24, 25, 26 and 27 may be provided in the back surface 28 of the lower container portion 3 for facilitating mounting the clamshell type container 1 to an external member, such as a wall or kitchen cabinet (not shown).

In addition, the top surface of the upper container portion 2 may also be provided with two or more of mounting holes 30, 31, 32 and 33 for facilitating mounting the clamshell type container 1 to the under surface of some external member, such as a kitchen cabinet (not shown). It should be appreciated that when the upper container portion 2 is mounted to an external member, the lower container portion 3 may be hingedly swung open from loading and unloading the material to be dispensed.

It should also be appreciated that other forms of releasable locking or latching mechanisms may be employed in connection with the present invention.

It should also be appreciated that when the container 1 is fabricated from substantially transparent material, the material to be dispensed will be more visible.

While the illustrated embodiment shows a particular releasable locking or latching mechanism, various other mechanisms may be used, such as for example, a friction fit between the upper and lower container portions 2 and 3; at least one spring which is stable when the box is either in the open or closed position; magnetic catches; interlocking buttons; etc.

While the foregoing has described the present invention in connection with a particular embodiment, it will be readily apparent to those skilled in the art that changes and modifications may be made without departing from the spirit of the present invention or the scope of the present invention as defined by the appended claims.

We claim:

1. A clamshell type container for storing a conventional box of rolled sheet material and for dispensing said rolled sheet material from said box, comprising:

an upper container portion comprising a top wall and a front wall;

a lower container portion comprising a bottom wall and a back wall, said back wall of said lower container portion being hingedly interconnected to said top wall of said upper container portion;

side wall members comprising first side wall members provided respectively at opposite ends of said upper container portion, and second side wall members provided respectively at opposite ends of said lower container portion;

said first and second side wall members being disposed in substantially overlapping relation to each other in said closed position of said container;

said upper container portion, said lower container portion, and said side wall members being fabricated of a substantially rigid material and together forming an enclosure shaped and dimensioned to closely receive therein said conventional box of rolled sheet material;

means for releasably locking said upper container portion and said lower container portion in a closed position, said locking means being disposed on said side wall members;

said locking means comprising a resiliently-biased locking member provided on at least one of said side wall members, and means for engaging said locking member provided on a corresponding side wall member disposed in substantially overlapping relation to said at least one side wall member in said closed position of said container;

said engaging means comprising a side wall edge portion which urges said locking member inwardly as said container is being closed, and a contiguous arcuate concave portion of said side wall within which said locking member automatically seats when said container is in said closed position;

said upper container portion and said lower container portion when in said closed position forming a predetermined aperture between a lower edge portion of said front wall and a forward edge portion of said bottom wall through which at least a portion of said sheet material is extended when said conventional box of rolled sheet material is operably disposed in said container; and means for cutting said sheet material, said cutting means being disposed adjacent said predetermined aperture and along said lower edge portion of said front wall.

2. A clamshell type container according to claim 1, wherein:

an inner surface portion of said front wall contacts a front surface of said conventional box of rolled sheet material when said box is operably disposed within said container.

3. A clamshell type container according to claim 1, wherein:

said cutting means comprises a serrated cutting portion provided along an inner lower edge portion of said front wall; and a substantially smooth safety edge is provided along an outer lower edge portion of said front wall, adjacent said serrated cutting edge.

4. A clamshell type container according to claim 3, wherein:

said serrated cutting portion comprises a series of teeth which are tapered from a maximum dimension of said teeth at an inner surface of said front wall lower edge portion to a minimum dimension of said teeth adjacent said smooth safety edge.

5. A clamshell type container according to claim 1, wherein:

one of said resiliently-biased locking members is provided on each of said second side wall members, each said locking member being biased outwardly;

said engaging means is provided on each of said first side wall members.

6. A clamshell type container according to claim 5, wherein:

said cutting means comprises a serrated cutting portion provided along an inner lower edge portion of said front wall;

a substantially smooth safety edge is provided along an outer lower edge portion of said front wall, adjacent said serrated cutting edge; and said serrated cutting portion comprises a series of teeth which are tapered from a maximum dimension of said teeth at an inner surface of said front wall lower edge portion to a minimum dimension of said teeth adjacent said smooth safety edge.

7. A clamshell type container according to claim 6, wherein:

said upper container portion, said lower container portion, said side wall members, and said cutting means are fabricated of a substantially rigid, transparent material.

8. A container for mounting a conventional box of rolled sheet material to an external surface, and for dispensing said rolled sheet material from said box, comprising:

an upper container portion comprising a top wall and a front wall;

a lower container portion comprising a bottom wall and a back wall, said back wall of said lower container portion being hingedly interconnected to said top wall of said upper container portion;

side wall members provided at respective ends of at least one of said upper and lower container portions;

said upper container portion, said lower container portion, and said side wall members being fabricated of a rigid unbendable material and together forming a substantially rectangular parallelepiped enclosure shaped and dimensioned to closely receive therein said conventional box of rolled sheet material;

means for releasably locking said upper container portion and said lower container portion in a closed position, said locking means being disposed on said side wall members;

said upper container portion and said lower container portion when in said closed position forming a predetermined aperture between a lower edge portion of said front wall and a forward edge portion of said bottom wall through which at least a portion of said sheet material is extended when said conventional box of rolled sheet material is operably disposed in said container;

means for cutting said sheet material, said cutting means being disposed adjacent said predetermined aperture and along said lower edge portion of said front wall;

means for mounting said container to an external surface, said mounting means being provided on a rigid unbendable portion of said container substantially distal from said cutting means;

said mounting means comprising a plurality of holes formed in at least one wall of said container;

said cutting means comprising a serrated cutting portion provided along an inner lower edge portion of said front wall;

a substantially smooth safety edge being provided along an outer lower edge portion of said front wall, adjacent said serrated cutting edge;

said serrated cutting portion comprising a series of teeth which are tapered from a maximum dimension of said teeth at an inner surface of said front wall lower edge portion to a minimum dimension of said teeth adjacent said smooth safety edge;

said side wall members comprising first side wall members provided respectively at opposite ends of said upper container portion, and second side wall members provided respectively at opposite ends of said lower container portion;

said first and second side wall members being disposed in substantially overlapping relation to each other in said closed position of said container;

said locking means comprising a resiliently-biased locking member provided on at least one of said side wall members, and means for engaging said locking member provided on a corresponding side wall member disposed in substantially overlapping relation to said at least one side wall member in said closed position of said container;

one of said resiliently-biased locking members being provided on each of said second side wall members, each said locking member being biased outwardly;

said engaging means being provided on each of said first side wall members; and each said engaging means comprising a side wall edge portion which urges said locking member inwardly as said container is being closed, and a contiguous arcuate concave portion of said side wall within which said locking member automatically seats when said container is in said closed position.

* * * * *